US006293205B1

(12) United States Patent
Butler

(10) Patent No.: US 6,293,205 B1
(45) Date of Patent: Sep. 25, 2001

(54) TRAIN COLLISION SYSTEM

(76) Inventor: Paul A. Butler, 4624 W. Aire Dr., West Jordan, UT (US) 84088

( * ) Notice: Subject to any disclaimer, the term of this patent is extended or adjusted under 35 U.S.C. 154(b) by 0 days.

(21) Appl. No.: 09/510,736

(22) Filed: Feb. 22, 2000

(51) Int. Cl.[7] ..... B61G 11/12
(52) U.S. Cl. ..... 105/392.5; 105/394; 404/6
(58) Field of Search ..... 105/5, 6, 7, 392.5, 105/394; 404/6, 9

(56) References Cited

U.S. PATENT DOCUMENTS

| | | | | |
|---|---|---|---|---|
| 25,970 | * | 11/1859 | Johnson | 105/392.5 |
| 482,143 | * | 9/1892 | Stierle | 105/5 |
| 724,490 | * | 4/1903 | Noever | 105/392.5 |
| 846,463 | * | 2/1907 | Kerekes | 105/6 |
| 2,257,084 | | 9/1941 | Dean | 105/402 |
| 3,880,404 | * | 4/1975 | Fitch | 256/1 |
| 4,008,915 | * | 2/1977 | Walker | 293/60 |
| 4,823,707 | * | 4/1989 | Salsbury et al. | 105/377 |
| 5,498,057 | * | 3/1996 | Reina et al. | 296/100 |
| 5,908,123 | | 6/1999 | Huggins | 213/223 |
| 6,092,959 | * | 7/2000 | Leonhardt et al. | 404/6 |

* cited by examiner

*Primary Examiner*—S. Joseph Morano
*Assistant Examiner*—Frantz F. Jules
(74) *Attorney, Agent, or Firm*—Peter Loffler

(57) ABSTRACT

A train collision system helps reduce the severity of impact between a train and a land vehicle or pedestrian. The system uses a flatbed rail car that is coupled to the front of a train. Several deformable barrels, each at least partially filled with an inert material, are attached to the top surface of the rail car, the barrels each decelerating an object that strikes them. A pair of diagonally downwardly disposed arms extend out from the front of the rail car and are used to either deflect the object out of the trains path or to scoop the object onto the rail car wherein the object is decelerated by the barrels. A net member subsystem captures relatively small objects and nets them before the object strikes the barrels.

26 Claims, 5 Drawing Sheets

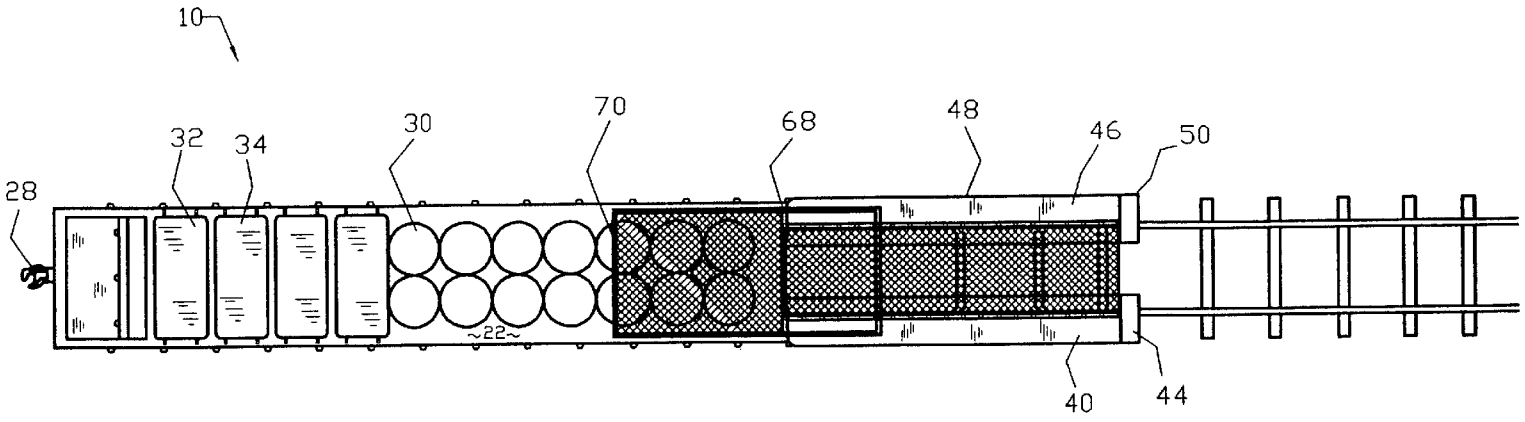
Fig. 6
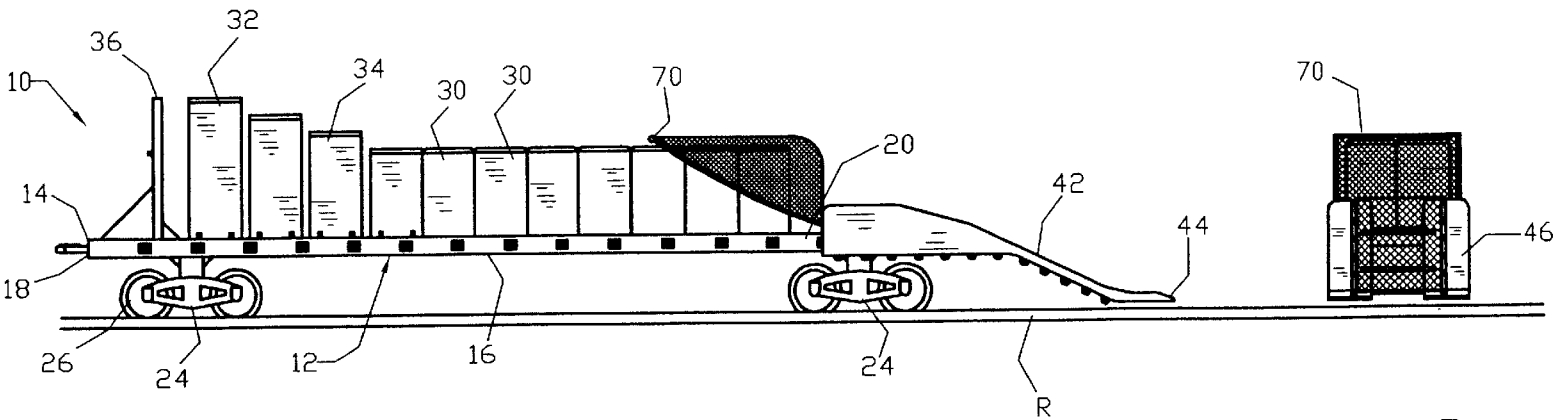
Fig. 5
Fig. 7

TRAIN COLLISION SYSTEM

BACKGROUND OF THE INVENTION

1. Field of the Invention

The present invention relates to a system for use with a train for reducing the severity of impact between the train and a land vehicle or pedestrian.

2. Background of the Prior Art

Collisions between trains and road vehicles such as cars or trucks and between trains and pedestrians kill hundreds and injure thousands of people in the United States each year. In order to reduce these casualties, many prevention methods have been deployed. Such methods include warning signage, median barriers, active barrier crossing, grade separation, illegal crossing monitoring and ticketing, public awareness campaigns, as well as other methods. While these prevention methods appear to have an effect in reducing the number of train and land vehicle/pedestrian collisions and the resulting deaths and injuries, such collisions still occur. Many car and truck drivers and pedestrians ignore the barriers or attempt to "beat" the train, while some pedestrians continue to walk along the tracks and may never hear the train that hits them. A train that is moving at 45 miles per hour has little chance of avoiding an object that is 250 yards away. Furthermore, a collision with a larger object such as a car or a truck may result in the train derailing, thereby causing collateral deaths and injuries to passengers on the train and to people in the area surrounding the point of derailment caused either by impact with the train itself or as a result of the train releasing a hazardous cargo such as toxic fumes or flammable substances that ignite.

In order to further reduce the deaths and injuries that result from train and land vehicle/pedestrian collisions, it must be assumed that such collisions will still occur regardless of the prevention methods that are undertaken. Accordingly, the severity of the actual collision must be reduced in order to reduce the deaths and injuries from the collisions.

Therefore, there is a need in the art for a train collision system that reduces the resulting deaths and injuries from a train and land vehicle and/or pedestrian collision. Such a system must absorb the energy that results from the collision without a substantial portion of that energy being imparted on the object which the train strikes. The train collision system must reduce the likelihood that a train will derail when it strikes an object in its right of way. Ideally, the system must be utilizable with current trains without requiring that the trains by modified in any fashion.

SUMMARY OF THE INVENTION

The train collision system of the present invention addresses the aforementioned needs in the art. The train collision system provides a device which is added to the front of an existing train and which absorbs a substantial portion of the energy that results when a train hits an object which is in the train's path. The system either deflects the object being hit or accelerates the object to the train's speed and carries the object until the train stops, thereby reducing the potential for train derailment.

The train collision system of the present invention is comprised of a flatbed rail car having a top surface, a bottom surface, a first end and a second end separated by a medial portion, the rail car coupled to the front of a train by a standard rail car coupler. A plurality of first barrels each having a first height are each attached to the top surface of the rail car at the medial portion. A first inert material at least partially fills each of the first plurality of first barrels, the inert material being water, sand, high density foam or the like. A second barrel is attached to the top surface of the rail car and is disposed between the plurality of first barrels and the second end, the second barrel having a second height that is greater than the first height A second inert material, similar to the first inert material, at least partially fills the second barrel. A third barrel is attached to the top surface and is disposed between the plurality of first barrels and the second barrel, the third barrel having a third height that is greater than the first height and lesser than the second height. A third inert material, similar to the first inert material and the second inert material, at least partially filling the third barrel. A rigid frame member extends upwardly from the top surface of the rail car proximate the second end. A cover, made from an appropriate material such as canvas, plastic, sheet metal, etc., may be attached to the flatbed rail car and positioned so as to cover the various barrels. A first arm is attached to the first end and extends outwardly therefrom, the first arm having a first portion that is disposed diagonally downwardly relative to the top surface and a pointed end. A second arm is attached to the first end and extends outwardly therefrom in generally coextensive fashion to the first arm, the second arm having a second portion that is disposed diagonally downwardly relative to the top surface and a second pointed end. Cross arms extend between the first arm and the second arm while respective risers are used to attached each arm to the top surface of the rail car. A resilient covering may be attached to the top of each arm. A net member may be provided, the net member having a first side, a second side, a third end, and a fourth end, the first side attached to the first arm and to the top surface, the second side attached to the second arm and to the top surface, the third end attached to the first arm and the second arm, and the fourth end positioned over top at least one of the plurality of first barrels. A first bracket is pivotally attached to the first arm and to the second arm, and attached to a portion of the first side, a portion of the second side and to the third end while a second bracket is pivotally attached to the first arm and to the second arm, and is attached to a portion of the first side, a portion of the second side and to the fourth end. Means are provided for pivotally moving the first bracket toward the second bracket and the second bracket toward the first bracket.

In use, the second end of the rail car of the train collision system is coupled to the front end of a train. If the train collides with an object, the pointed ends of the first arm and the second arm either deflect the object out of the way of the moving train or scoop the object up and onto the rail car. The inert material filled barrels decelerate rearward movement of the object, with the third and second barrels, by being increasingly higher, provide relatively greater deceleration as the object moves toward the train proper. If the object has sufficient force so as not to be fully decelerated by the various barrels, the frame member helps prevent the object from striking the train proper. If the train collision system makes impact with a relatively small object, such as a human, the first arm or the second arm help deflect the human out of the train's path, the resilient coverings helping to reduce the severity of injury that results from the impact. Alternately, the human may be positioned between the two arms, wherein the person is caught in the net member, in which case the first bracket and the second bracket come toward one another and capture the human within the basket that is formed by the net member and the two brackets. In this case, the resilient coverings, by being relatively soft, are broken away as the third bracket articulates toward the fourth bracket.

BRIEF DESCRIPTION OF THE DRAWINGS

FIG. 5 is a side view of the train collision system utilizing a net system.

FIG. 6 is a top plan view of FIG. 5.

FIG. 7 is a front elevation view of FIG. 5.

Similar reference numerals refer to similar parts throughout the several views of the drawings.

DESCRIPTION OF THE PREFERRED EMBODIMENT

Figure 2:
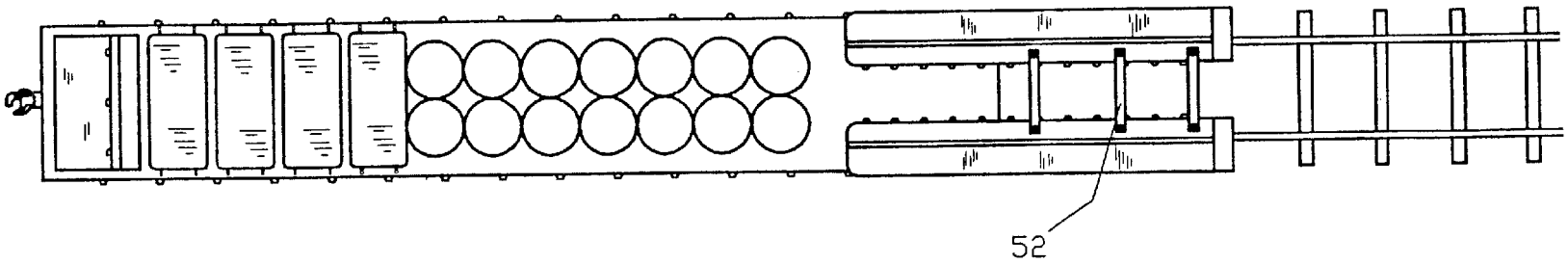
FIG. 2 is a top plan view of the train collision system.
Figure 3:
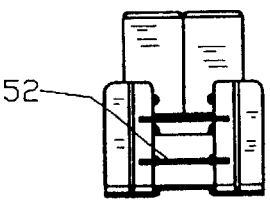
FIG. 3 is a front elevation view of the train collision system.
Figure 1:
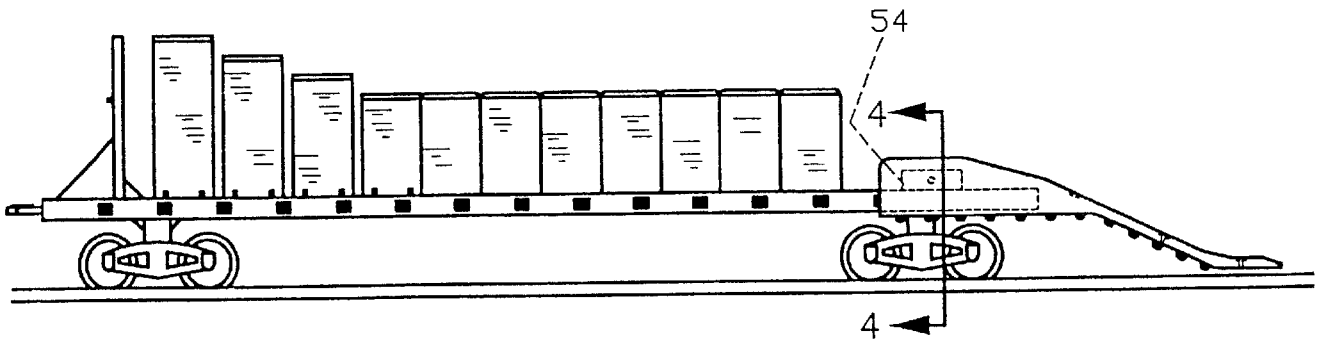
FIG. 1 is a side view of the train collision system of the present invention.
Figure 4:
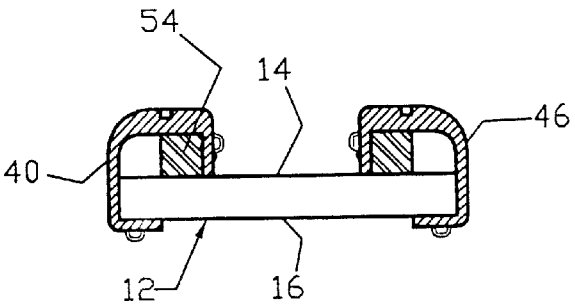
FIG. 4 is a sectioned view of the train collision system taken along line 4—4 in FIG. 1.
Figure 12:
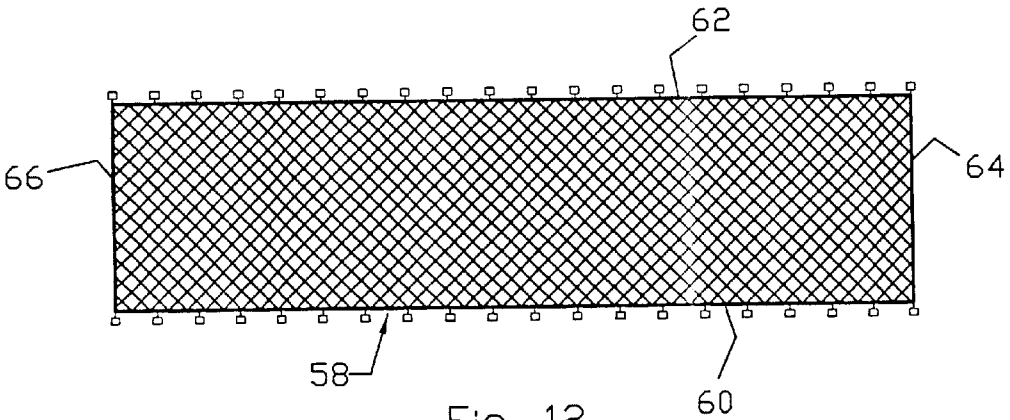
FIG. 12 is a top plan view of the net member.
Figure 9:
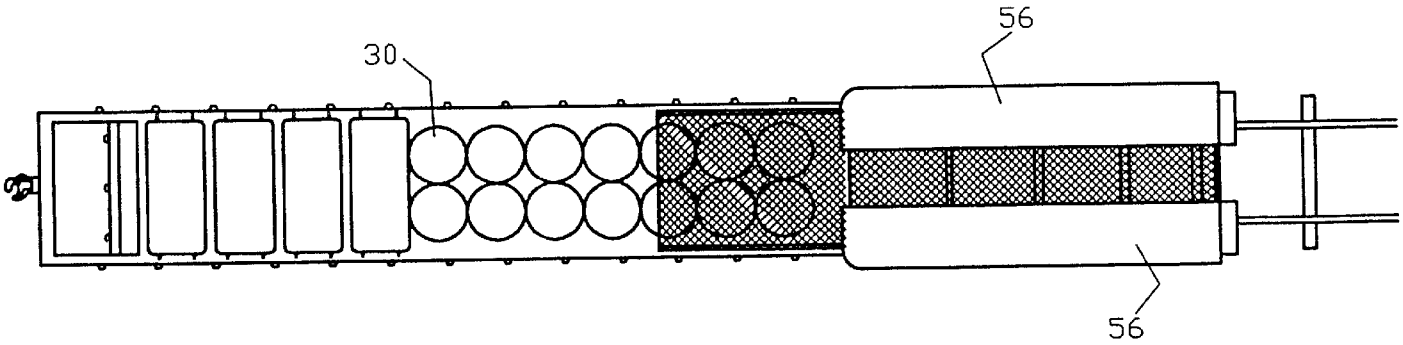
FIG. 9 is a top plan view of FIG. 8.
Figure 8:
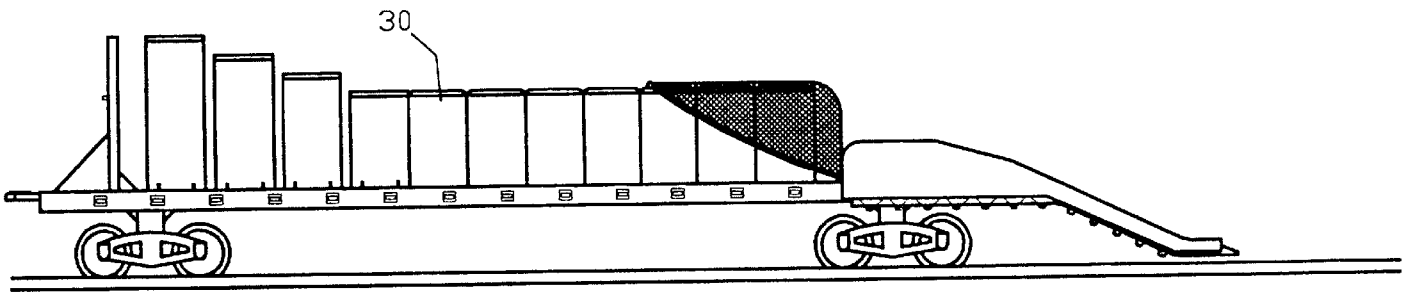
FIG. 8 is a side view of the train collision system utilizing a covering attached to each arm.
Figure 11:
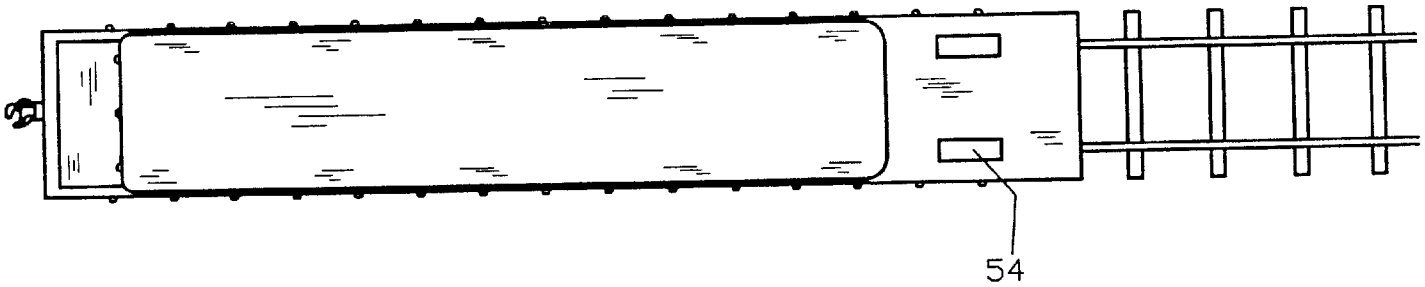
FIG. 11 is a top plan view of FIG. 10.
Figure 10:
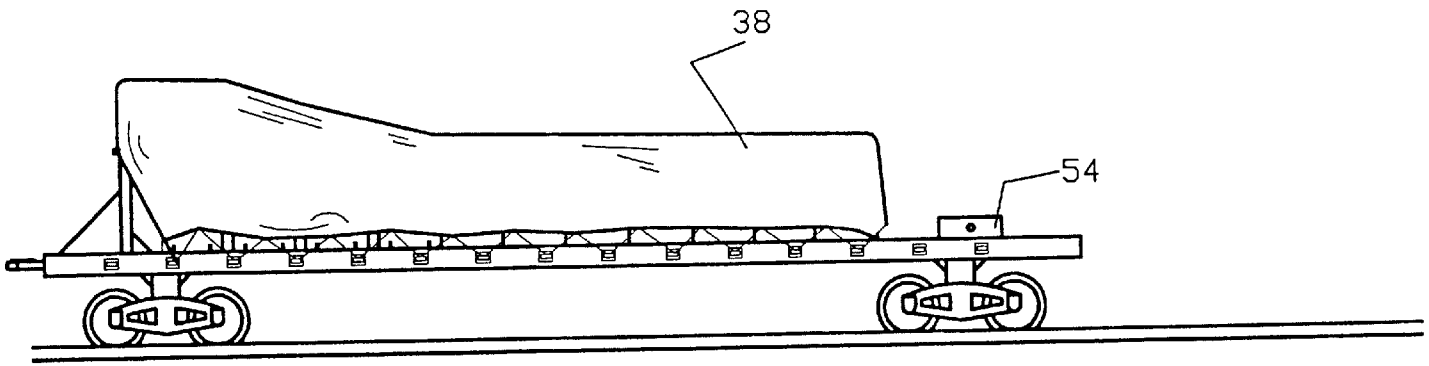
FIG. 10 is a side elevation view of the train collision system utilizing a covering for the barrels.

Referring now to the drawings, it is seen that the train collision system, generally denoted by reference numeral 10, is comprised of a flatbed rail car 12 having a top surface 14, a bottom surface 16, a first end 18 and a second end 20 separated by a medial portion 22. The rail car 12 has a pair of spaced apart rail carriages 24 extending downwardly from the bottom surface 16, the wheels 26 of the rail carriages adapted to ride on rails R in standard fashion. The rail car 12 is coupled to the front of a train (not illustrated) by a standard rail car coupler 28. A plurality of first barrels 30 each having a first height are each attached to the top surface 14 of the rail car 12 at the medial portion 22. A first inert material at least partially fills each of the first plurality of first barrels 30, the inert material being water, sand, high density foam or the like. The plurality of first barrels 30 may extend along substantially the entire medial portion 22 or, as illustrated progressively higher barrels 32 and 34 can be used in moving toward the second end 20 of the rail car 12. As such, at least one second barrel 32 is attached to the top surface 14 of the rail car 12 and is disposed between the plurality of first barrels 30 and the second end 20, the second barrel 32 having a second height that is greater than the first height. A second inert material, similar to the first inert material, at least partially fills the second barrel 32. If further desired, at least one third barrel 34 (and a fourth barrel (not illustrated) etc., can be used) is attached to the top surface 14 and is disposed between the plurality of first barrels 30 and the second barrel 32, the third barrel 34 having a third height that is greater than the first height and lesser than the second height. A third inert material, similar to the first inert material and the second inert material, at least partially filling the third barrel 34. The various barrels 30, 32, and 34, can be made from any appropriate material such plastic, metal, and the like. The various barrels 30, 32, and 34, can each be made from different materials so that the barrels located relatively closer to the second end 20 provide more deceleration properties relative to the deceleration properties of the barrels located relatively closer to the first end 18. The barrels 30 that are closest to the first end 18 of the rail car 12 may be aerodynamically shaped in order to reduce drag as the train collision system 10 moves forwardly.

A rigid frame member 36 extends upwardly from the top surface 14 of the rail car 12 proximate the second end 20. A cover 38, made from an appropriate material such as canvas, plastic, sheet metal, etc., may be attached to the flatbed rail car 12 and positioned so as to cover the various barrels 30, 32, and 34, and frame 36. A first arm 40 is attached to the second end 20 and extends outwardly therefrom, the first arm 40 having a first portion 42 that is disposed diagonally downwardly relative to the top surface 14 and a first pointed end 44. A second arm 46 is attached to the second end to 20 and extends outwardly therefrom in generally coextensive fashion to the first arm 40, the second arm 46 having a second portion 48 that is disposed diagonally downwardly relative to the top surface 14 and a second pointed end 50. Cross arms 52 extend between the first arm 40 and the second arm 46. Risers 54 are used to attach each arm 40 and 46 to the top surface 14 of the rail car 12. A resilient covering 56 may be attached to the top of each arm 40 and 46, the coverings 56 being made from an appropriate relatively soft material such as high density foam or water resistant molded thermoform plastic.

A net member 58 may be provided, the net member 58 having a first side 60, a second side 62, a third end 64, and a fourth end 66, the first side 60 attached to the first arm 40 and to the top surface 14, the second side 62 attached to the second arm 46 and to the top surface 14, the third end 64 attached to the first arm 40 and the second arm 46, and the fourth end 66 positioned over top at least one of the plurality of first barrels 30. A first bracket 68 is pivotally attached to the first arm 40 and to the second arm 46, and is attached to a portion of the first side 60, a portion of the second side 62 and to the third end 64 of the net member 58, while a second bracket 70 is pivotally attached to the first arm 40 and to the second arm 46, and is attached to a portion of the first side 60, a portion of the second side 62 and to the fourth end 66 of the net member 58. In a normally relaxed positioned, a portion of the first bracket 68 is positioned against the first arm 40 and the second arm 46 and may be attached thereto, while a portion of the second bracket 70 is positioned atop at least one of the barrels 30 and may be secured thereto. Means are provided for pivotally moving the first bracket 68 toward the second bracket 70 and the second bracket 70 toward the first bracket 68.

In use, the first end 18 of the rail car 12 of the train collision system 10 is coupled to the front end of a train (not illustrated). If the train collides with an object, the first arm 40 and the second arm 46 either deflect the object out of the way of the moving train or scoop the object up (with the help of the pointed ends 44 and 50 of the first arm 40 and the second arm 46 respectively) and onto the rail car 12. The inert material filled barrels 30, 32, and 34 decelerate rearward movement of the object, with the third barrels 32 and second barrels 34, by being increasingly taller (and thus having more inert material therein and thus having more decelerating capacity), provide relatively greater deceleration as the object moves toward the train proper. This progressively increasing deceleration design allows a small object, such as a car to be decelerated by several of the first barrels 30, each first barrel 30 offering a portion of the deceleration action, thereby allowing the deceleration to be accomplished by a large number of barrels 30 spread across a relatively long distance, and thereby decreasing the energy transfer to the object itself. For a relatively larger object, such as a truck, the first barrels 30 provide the initial deceleration, while the third barrels 32 and the second barrels 34 providing an increasing level of deceleration to finish the stopping of the object. If the object is larger still, such as a fully loaded truck, the frame member 36 helps prevent the object from striking the train proper. If the train collision system 10 makes impact with a relatively small object, such as a human, the first arm 40 or the second arm 46 help deflect the human out of the train's path, the resilient coverings 56 helping to reduce the severity of injury that results from the impact. Alternately, the human may be positioned between the two arms 40 and 46, wherein the person would be caught in the net member 58, in which case the first bracket 68 and the second bracket 70 come toward one another and capture the human within the basket that is formed by the net member 58 and the two brackets 68 and 70. Appropriate means (not illustrated) are used to accomplish this feat. Such means can include spring-loading the brackets 68 and 70 such that a collision triggers appropriate releases on the springs (similar to a mouse trap), providing motors on the first bracket 68 and the second bracket 70 and having sensors on the net member subsystem that sense a collision and activate the motors, etc. When the brackets 68 and 70 are articulated toward each other, the resilient coverings 56, by being relatively soft, are broken away. Additionally, the net member 58, the first bracket 68, and the second bracket 70 are each attached to their respective various components so that each easily breaks away therefrom when a collision occurs.

While the invention has been particularly shown and described with reference to an embodiment thereof, it will be appreciated by those skilled in the art that various changes in form and detail may be made without departing from the spirit and scope of the invention.

I claim:

1. A train collision system comprising:

a flatbed rail car having a top surface, a bottom surface, a first end and a second end separated by a medial portion;

a plurality of first barrels each having a first height and each attached to the top surface at the medial portion;

a first inert material at least partially filling each of the plurality of first barrels;

a second barrel attached to the top surface and disposed between the plurality of first barrels and the second end, the second barrel having a second height that is greater than the first height; and a second inert material at least partially filling the second barrel.

2. The train collision system as in claim 1 wherein the first inert material is selected from the group consisting of water, sand, or foam.

3. The train collision system as in claim 1 wherein the second inert material is selected from the group consisting of water, sand, or foam.

4. The train collision as in claim 1 further comprising:

a third barrel attached to the top surface and disposed between the plurality of first barrels and the second barrel, the third barrel having a third height that is greater than the first height and lesser than the second height; and a third inert material at least partially filling the third barrel.

5. The train collision system as in claim 4 wherein the third inert material is selected from the group consisting of water, sand, or foam.

6. The train collision system as in claim 1 further comprising a rigid frame member extending upwardly from the top surface proximate the second end.

7. The train collision system as in claim 1 further comprising a cover attached to the flatbed rail car and positioned over the plurality of first barrels in covering fashion.

8. The train collision system as in claim 1 further comprising:

a first arm attached to the first end and extending outwardly therefrom, the first arm having a first portion that is disposed diagonally downwardly relative to the top surface; and a second arm attached to the first end and extending outwardly therefrom in generally coextensive fashion to the first arm, the second arm having a second portion that is disposed diagonally downwardly relative to the top surface.

9. The train collision system as in claim 8 further comprising a cross arm extending between the first arm and the second arm.

10. The train collision system as in claim 8 wherein an end of the first arm is pointed and an end of the second arm is pointed.

11. The train collision system as in claim 8 wherein the first arm is attached to the top surface via a first riser and the second arm is attached to the top surface via a second riser.

12. The train collision system as in claim 8 further comprising:

a resilient first covering attached to the first arm; and a resilient second covering attached to the second arm.

13. The train collision system as in claim 8 further comprising a net member having a first side, a second side, a third end, and a fourth end, the first side attached to the first arm and to the top surface, the second side attached to the second arm and to the top surface, the third end attached to the first arm and the second arm, and the fourth end positioned over top at least one of the plurality of first barrels.

14. The train collision system as in claim 13 first comprising:

a first bracket pivotally attached to the first arm and to the second arm, and attached to a portion of the first side, a portion of the second side and to the third end; and a second bracket pivotally attached to the first arm and to the second arm, and attached to a portion of the first side, a portion of the second side and to the fourth end.

15. The train collision system as in claim 14 further comprising means for pivotally moving the first bracket toward the second bracket and the second bracket toward the first bracket.

16. A train collision system comprising:

a flatbed rail car having a top surface, a bottom surface, a first end and a second end separated by a medial portion;

a plurality of first barrels each having a first height and each attached to the top surface at the medial portion; and a first inert material at least partially filling each of the first plurality of first barrels;

a first arm attached to the first end and extending outwardly therefrom, the first arm having a first portion that is disposed diagonally downwardly relative to the top surface; and a second arm attached to the first end and extending outwardly therefrom in generally coextensive fashion to the first arm, the second arm having a second portion that is disposed diagonally downwardly relative to the top surface.

17. The train collision system as in claim 16 wherein the first inert material is selected from the group consisting of water, sand, or foam.

18. The train collision system as in claim 16 further comprising a rigid frame member extending upwardly from the top surface proximate the second end.

19. The train collision system as in claim 16 further comprising a cover attached to the flatbed rail car and positioned over the plurality of first barrels in covering fashion.

20. The train collision system as in claim 19 further comprising a cross arm extending between the first arm and the second arm.

21. The train collision system as in claim 19 wherein an end of the first arm is pointed and an end of the second arm is pointed.

22. The train collision system as in claim 19 wherein the first arm is attached to the top surface via a first riser and the second arm is attached to the top surface via a second riser.

23. The train collision system as in claim 19 further comprising:

a resilient first covering attached to the first arm; and a resilient second covering attached to the second arm.

24. The train collision system as in claim 19 further comprising a net member having a first side, a second side, a third end, and a fourth end, the first side attached to the first arm and to the top surface, the second side attached to the second arm and to the top surface, the third end attached to the first arm and the second arm, and the fourth end positioned over top at least one of the plurality of first barrels.

25. The train collision system as in claim 24 first comprising:

a first bracket pivotally attached to the first arm and to the second arm, and attached to a portion of the first side, a portion of the second side and to the third end; and a second bracket pivotally attached to the first arm and to the second arm, and attached to a portion of the first side, a portion of the second side and to the fourth end.

26. The train collision system as in claim 25 further comprising means for pivotally moving the first bracket toward the second bracket and the second bracket toward the first bracket.

* * * * *